US005107809A

United States Patent [19]

Suh

[11] Patent Number: 5,107,809

[45] Date of Patent: Apr. 28, 1992

[54] ENGINE BLOCK AND BEARING ASSEMBLY

[75] Inventor: Chung M. Suh, Ann Arbor, Mich.

[73] Assignee: Kia Motors Corporation, Seoul, Rep. of Korea

[21] Appl. No.: 706,373

[22] Filed: May 28, 1991

[51] Int. Cl.[5] ..... F02F 7/00

[52] U.S. Cl. ..... 123/195 H; 384/429

[58] Field of Search ..... 123/195 H, 195 R, 195 C; 384/429, 432

[56] References Cited

U.S. PATENT DOCUMENTS 4,465,041 8/1984 Hayashi ..... 123/195 H
4,520,771 6/1985 Hayashi ..... 123/195 H
4,836,159 6/1989 Löbig ..... 123/195 H
4,848,292 7/1989 Holtzberg ..... 123/195 C
4,922,870 5/1990 Pietsch et al. ..... 384/429

*Primary Examiner*—E. Rollins Cross
*Assistant Examiner*—Weilun Lo
*Attorney, Agent, or Firm*—Bielen, Peterson & Lampe

[57] ABSTRACT

An improved engine block and crankshaft bearing assembly with an arrangement of the engine block and the bearing assembly that simplifies casting of the engine block, with the block having cylinders and a crankcase with opposed spaced support structures in the crankcase for mounting thin profile, forged steel upper bearing caps between adjacent cylinders with the upper bearing caps spanning the spaced support structures and coupling to conventional bearing caps for at least the main bearings of the crankshaft between the end bearings.

10 Claims, 1 Drawing Sheet

ENGINE BLOCK AND BEARING ASSEMBLY

BACKGROUND OF THE INVENTION

This invention relates to an improved engine block casting and crankshaft bearing assembly, and in particular relates to an arrangement of a cast engine block and crankshaft bearing assembly that simplifies casting of the engine block and enables seating of the crankshaft in a bearing assembly that has means for minimizing vibrations transmitted between the crankshaft and the engine block. In addition to simplifying the engine block casting, the improved construction provides for a lighter weight assembly that is less expensive to fabricate.

In casting prior art engine blocks, the support structure for the crankshaft bearings has typically included a web divider in the crankcase structure below the engine cylinders. The cast divider included the upper bearing cap integrally formed into the divider structure. Bearing shells are installed in an upper crescent of the upper bearing cap and in a removable lower bearing cap which is secured to the upper bearing cap by a pair of spaced bolts. Locating a cast divider between each of a plurality of cylinders complicates the structure of the engine block and adds to its expense and weight.

Since the thrust of the pistons is directed to the crank pins of the rotating crankshaft, the main forces of piston thrust are transmitted to the lower bearing cap and to the engine block casting via the cap bolts. Forces on the shell of the upper bearing cap that encases the bearing sleeve are not as extensive and, therefore, materials other than rigid cast materials can be utilized to advantage. Although high strength, forged steel parts can be fabricated with minimum material for lightness of weight, such parts have traditionally not been used for bearing caps for the crankshaft.

It is a primary object of this invention to utilize a forged steel upper bearing cap in a cast engine block to simplify the casting of the block. In addition, the use of a formed bearing cap enables the composition and structure to be optimized for the particular operating conditions encountered. It is a further object of this invention to incorporate the forged bearing cap in an assembly that includes a vibration damping material to insulate the engine block from vibrations imparted to the crankshaft by the connected piston and connecting rod assemblies. The engine block casting and crankshaft bearing assembly of this invention is particularly useful for automotive type engines where costs, fabrication procedures or other factors make the use of a removable upper bearing cap advantageous.

SUMMARY OF THE INVENTION

The engine block and bearing assembly of this invention relate to an improved structure for supporting the main bearing journals of a crankshaft in a reciprocal engine.

The improved crankshaft bearing housing is primarily designed for use in the crankshaft bearings between the for and aft end bearings. In this application the use of the improved crankshaft bearing housing eliminates the support web in the crank case portion of the engine block. The bearing assembly is adaptable for use in the end bearings for the crankshaft, particularly where the thickness in the wall of the engine block casting in the crankcase area is to be minimized for weight reduction or ease in fabrication.

The improved bearing assembly includes a removable, forged steel upper bearing cap that has a thin profile. The forged steel cap is contoured to maximize strength and minimize material. The upper bearing cap has a semi-circular central section with flat, tab sections at each end that position on mounting seats in the engine block casting. The mounting seats are formed on buttress-like supports in the wall of the crankcase portion of the engine casting and are designed to facilitate the fabrication of the engine block casting.

It is preferred to seat the tab sections of the upper bearing cap on a vibration absorbing material such as a hard Neoprene rubber or other material suitable for petroleum contact in the environment of the crankcase. The upper bearing caps have a cap face that interfaces the cap face of conventional bearing caps that are used for the lower bearing caps. These conventional caps are customarily cast and ground to a configuration that can withstand the higher magnitude downward forces directed by the crankshaft connected pistons during their thrust stroke.

Although the improved engine block and bearing assembly is primarily designed to eliminate central webs in the hollow crank case portion of the engine block casting, the novel bearing assembly can be utilized for the end bearings of the main bearing journals of the crankshaft. The bearing assembly utilizes conventional bearing shells that are retained by the upper and lower bearing caps using pins, slots or other conventional means. These and other features of the invention will become apparent upon a consideration of the drawings and the detailed description of the preferred embodiment.

DETAILED DESCRIPTION OF THE PREFERRED EMBODIMENT

Figure 1:
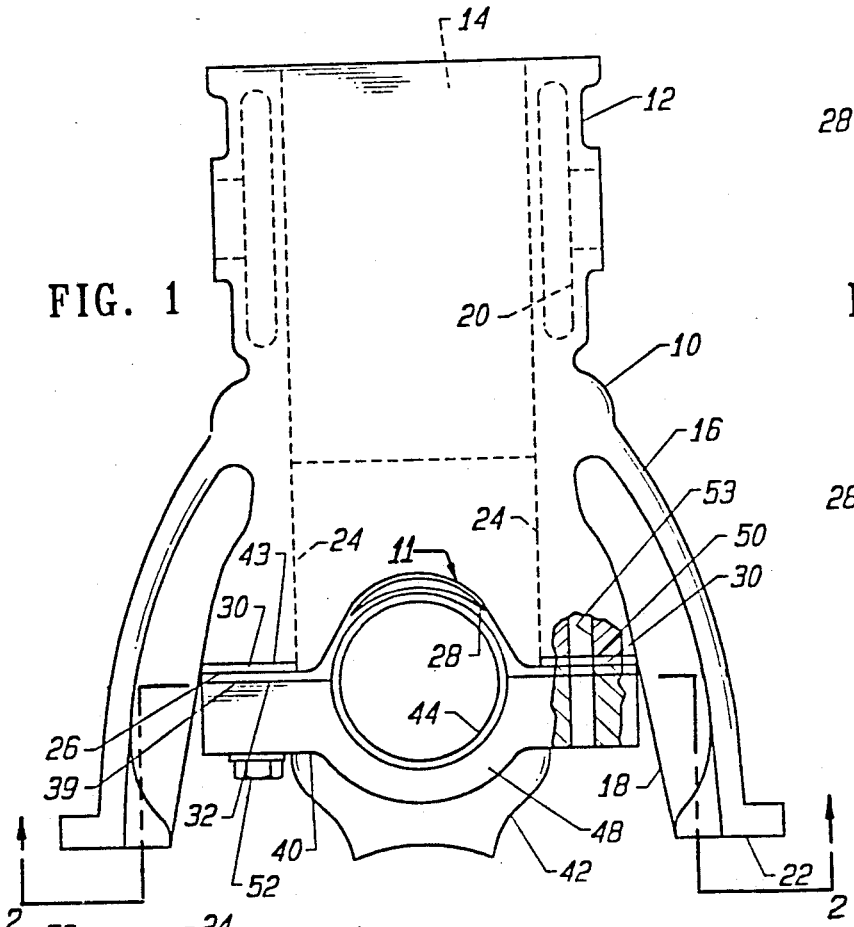
FIG. 1 is a cross sectional view of an engine block casting with the bearing assembly installed.

Referring to FIG. 1, a cross sectional view of a cast engine block 10 and a crankshaft bearing assembly 11 is shown. The engine block 10 has an upper portion 12 with one or more cylinders 14, and a lower portion 16 forming in part a crank case 18. The cast engine block 10 has the conventional features of a cooling passage 20 and a flared gasket seat 22 for a conventional oil pan (not shown). The engine block may be cast of an iron or aluminum material.

To facilitate casting of the engine block 10 the crank case 18 is cast without the structural webs between cylinders that support the integrally cast main bearing caps for the crankshaft in conventional engine blocks. Instead, the engine block 10 is cast with a series of buttresses 24 that project from the wall of the crankcase 18 to form an inverted, flat mounting pedestal 26 on which is seated an upper bearing cap 28. Preferably, the upper bearing cap 28 seats on a vibration absorbing pad 30 that is fabricated from a vibration damping material such as a high density neoprene rubber that is resistant to moderate heat, oil and other hydrocarbons that may come in contact with the pad. The pad may be impregnated with inertial material as is known in the art.

The upper bearing cap 28 is fabricated from a forged steel that may be hot or cold formed to a configuration that provides added strength to the generally strap-like construction. The upper bearing cap 28 has unitary flat, opposed end segments or tabs 32 that seat on the mounting pedestal 26 against the vibration pad 30 and an intermediate arcuate center segment, or bearing cradle 34, between the end segments 32 that encompasses part of the crankshaft 36.

Figure 3:
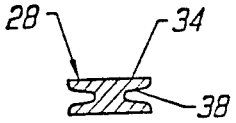
FIG. 3 is a cross sectional view of the upper bearing cap taken on the lines 3—3 in FIG. 1.
Figure 4:
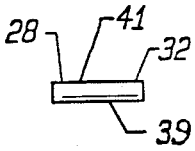
FIG. 4 is a cross sectional view taken on the lines 4—4 in FIG. 1.

As shown in FIG. 3, the center segment or bearing cradle 34 of the upper bearing cap 28 has a cross sectional contour that includes a constricted midsection 38 that provides for added structural strength in the fashion of a traditional I-beam structure. As shown in FIG. 4, the end segments 32 of the upper bearing cap 28 have a flat, rectangular cross section that may be milled to size for seating on the mounting pedestal 26. In this manner, the end segments 32 provide a flat cap face 39 for seating the lower bearing cap 40 and a flat seating face 41 on which the pad 30 is seated to provide a mounting face 43 to the engine block 10. The lower bearing cap 40 is formed from a casting and is of conventional structure with a central reinforcing rib 42 and thick structurally secure profile. The upper and lower bearing caps 28 and 40 encompass and carry a pair of bearing shells 44 which in turn encompass the main bearing journals 46 of the crankshaft. It is to be understood that when the damping pad 30 is not used, the seating face 41 of the end segments 32 becomes the mounting face 43 of the upper bearing cap 28.

As shown in the partially broken away view of one of the two ends of the bearing assembly 48 in FIG. 1, the pad 30 may include a bushing or spacer 50 to ensure that the bearing assembly is properly positioned around the crankshaft journal 46 when bolts 52 (one shown in FIG. 1) are threaded into tapped holes 53 in the face of the pedestal and tightened to secure the bearing assembly 48 to the engine block 10.

Figure 2:
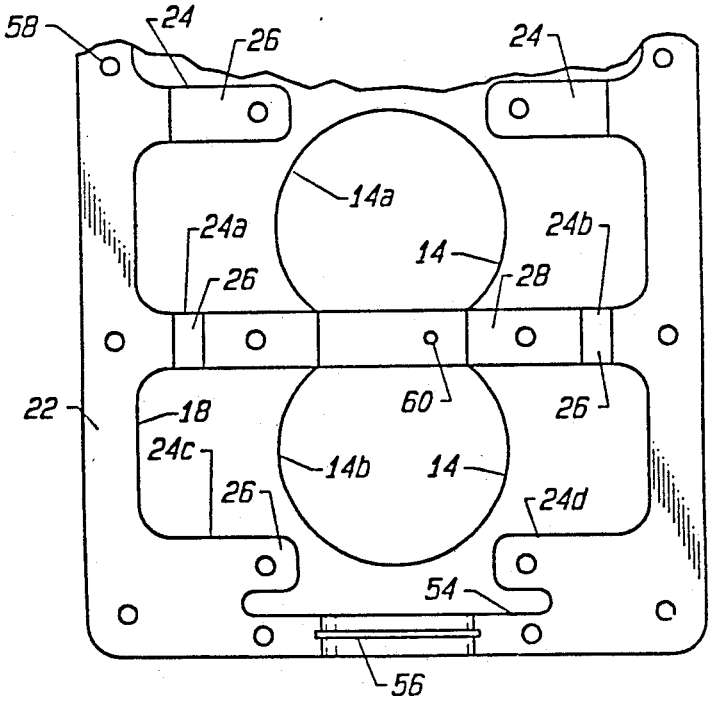
FIG. 2 is a partial bottom view taken on the lines 2—2 in FIG. 1, showing an upper bearing cap.

As shown in FIG. 2, the engine block 10 has a series of buttresses 24 arranged on each side of the line of cylinders 14 between adjacent cylinders 14. In FIG. 2 the upper bearing cap 28 is shown positioned against the mounting pedestals 26 spanning the two opposed buttresses **24*a* and 24*b* between the two cylinders 14*a* and 14*b* as illustrated. The primary purpose of the design is to eliminate in the cast block, the support web for the integrally cast upper bearing cap between adjacent cylinders. However, the engine block can be constructed with upper bearing caps of the type shown in FIGS. 1 and 2 for the main bearings at the ends of the crankshaft that are advantageously removable, and consistent in design. As shown in FIG. 2, by way of example, the engine block 10 includes a pair of opposed buttresses 24*c* and 24*d* having a mounting pedestal 26 against which is seated a forged steel upper bearing cap of the same design as the cap 28 shown in FIGS. 1–4. The engine block casting includes a conventional slot 54 for an oil slinger (not shown) on the crankshaft and/or the side rim of a thrust bearing (not shown) and a sealing groove 56** for sealing the crankcase around the end of the crankshaft in a conventional manner.

The crankcase 18 has a perimeter oil pan seat 22 with a series of holes 58 for attaching a conventional oil pan (not shown). The forged upper bearing cap 28 can be constructed to accommodate different types of bearing shells and may be constructed with a recess as is customary in conventional cradle designs or may simply include a pin 60 as shown in FIG. 2 by way of example. Other conventional features may be included in the bearing assembly to provide for oil passages and other necessities of particular engine designs.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A cast engine block and a crankshaft bearing assembly comprising:

a cast engine block having an upper portion with a plurality of cylinders and a lower portion with an improved crankcase, the crankcase having opposed, spaced, support members positioned between adjacent cylinders, each support member having a mounting surface;

a bearing assembly including a cast, conventional lower bearing cap and a forged steel, upper bearing cap, the upper cap having an arcuate central portion with projecting end portions positionable against the mounting surface of the support members; and, means for securing the lower bearing cap and the upper bearing cap to the support members of the engine block.

2. The engine block and bearing assembly of claim 1 wherein the crankcase has a wall and the spaced support members each comprise a projecting buttress integral with the wall of the crankcase.

3. The engine block and bearing assembly of claim 1 wherein the projecting end portions of the upper bearing cap include a vibration dampening pad, positioned between the end portions of the upper bearing cap and the mounting surface of the support members.

4. The engine block of claim 3 wherein the support members each have a tapped hole in the mounting surface and the securing means includes threaded bolts passing through the lower bearing cap and through the end portions of the upper bearing caps, the bolts being engageable with the tapped holes in the engine block for coupling the bearing caps and securing the caps to the engine block.

5. In an engine block for an internal combustion, reciprocal piston engine having at least one cylinder, a crankshaft and a bearing assembly for carrying the main journal bearings for the crankshaft with the assembly having a conventional lower bearing cap and bearing shells, an improved upper bearing cap comprising:

a thin profile, forged steel, unitary member with opposed end segments and an intermediate arcuate center segment, the center segment constructed to cradle a bearing shell and the end segments constructed to be coupled to the engine block.

6. The upper bearing cap of claim 5 wherein the end segments of the unitary forged steel member each have a mounting face with a vibration damping pad that interfaces the engine block.

7. The upper bearing cap of claim 6 wherein the vibration damping pad comprises an oil resistant rubber-like material.

8. The upper bearing cap of claim 5 wherein the thin profile, forged steel, unitary member has an arcuate center segment with a central portion having a cross sectional configuration that is of contoured, I-beam, shape.

9. The upper bearing cap of claim 8 wherein the thin profile, forged steel, unitary member has opposed end segments that have a cross sectional configuration that is rectangular in shape.

10. The upper bearing cap of claim 5 in combination with a cast engine block having a unitary upper portion with a plurality of cylinders and a lower portion with an improved crankcase, wherein the crankcase has opposed, spaced, support members positioned between adjacent cylinders, each support member having a mounting surface, and the opposed end segments of the forged steel, unitary member mount to the opposed support member with the center segment of the upper bearing cap spanning the opposed support members.

* * * * *